US005719476A

United States Patent [19]

Grote

[11] Patent Number: 5,719,476

[45] Date of Patent: Feb. 17, 1998

[54] APPARATUS FOR CORRECTING DISTORTION OF AN ELECTRON BEAM GENERATED SPOT ON A CATHODE RAY TUBE SCREEN

[75] Inventor: Michael Denton Grote, Mercerville, N.J.

[73] Assignee: David Sarnoff Research Center, Inc., Princeton, N.J.

[21] Appl. No.: 605,828

[22] Filed: Feb. 23, 1996

[51] Int. Cl.[6] ..... G09G 1/04; H01J 29/70; H01J 29/50

[52] U.S. Cl. ..... 315/370; 313/440; 315/399

[58] Field of Search ..... 315/370, 399; 335/210, 213; 313/440

[56] References Cited

U.S. PATENT DOCUMENTS

| | | | |
|---|---|---|---|
| 3,035,198 | 5/1962 | Skoyles | 315/382 |
| 3,849,749 | 11/1974 | Kadota | 335/210 |
| 4,257,024 | 3/1981 | Shimona et al. | 335/212 |
| 4,396,897 | 8/1983 | Sluijterman et al. | 335/212 |
| 4,758,762 | 7/1988 | Van Gorkum et al. | 313/440 |
| 5,028,850 | 7/1991 | Grote et al. | 315/371 |
| 5,039,923 | 8/1991 | Ogino et al. | 315/382 |
| 5,327,051 | 7/1994 | Johnson et al. | 315/368.28 |
| 5,408,163 | 4/1995 | Militi et al. | 315/370 |

FOREIGN PATENT DOCUMENTS 63-224614 3/1990 Japan .

OTHER PUBLICATIONS

T. Furukawa et al., "14.4: A 21 in. High-Resolution Monochrome Monitor with 700 nits and 5 Mpixels", SID 95 Digest, pp. 191–194.

C. A. Washburn, "A Magnetic Deflection Up-Date: Field Equations, CRT Geometry, The Distortions and Their Corrections", IEEE 1995, pp. 963–978, Nov. 1995.

*Primary Examiner*—Gregory C. Issing
*Attorney, Agent, or Firm*—William J. Burke

[57] ABSTRACT

A monochrome cathode ray tube (CRT) yoke includes harmonic windings for correcting spot distortion. In a first embodiment of the invention, the yoke includes harmonic windings in the entrance region of the yoke and harmonic windings in the exit region of the yoke. The harmonic windings in the entrance region produce a barrel-shaped field for correcting spot astigmatism along the diagonals of the CRT. The harmonic windings in the exit region of the yoke produce a pincushion-shaped field for correcting spot elongation along the diagonals of the CRT. In a second embodiment of the invention, the yoke includes harmonic windings only in the entrance region. A stigmator includes quadrupole coils driven at low power vertical scan rates. This allows the stigmator to be positioned near the electron gun and reduces the length of the CRT. In a third embodiment of the invention, the yoke includes harmonic windings only in the exit region.

18 Claims, 12 Drawing Sheets

HORIZONTAL 3RD HARMONIC MAGNETIC FIELD LINES

VERTICAL 3RD HARMONIC MAGNETIC FIELD LINES

APPARATUS FOR CORRECTING DISTORTION OF AN ELECTRON BEAM GENERATED SPOT ON A CATHODE RAY TUBE SCREEN

This invention was made with Government support under Contract No. 94-F15900-000 awarded by the Office of Research and Development. The Government has certain rights in this invention.

The invention relates generally to an apparatus for correcting distortion of a spot on a cathode ray tube (CRT) screen and, in particular, to a yoke including at least one harmonic winding for correcting the spot distortion.

BACKGROUND OF THE INVENTION

A spot appearing on a flat faced CRT experiences distortion away from the center of the CRT screen. The distortion occurs is because the electron beam, which produces the spot on the screen, is not perpendicular to the screen as the beam moves away from the center of the screen. The spot-shape distortion and raster geometry distortion of a uniform-field deflection yoke typically used in high-resolution CRT displays are illustrated in FIG. 1. The elliptical distortion of the spots is undesirable because it degrades resolution of the displayed image. The spot shapes can be fully corrected using a series of correction coils commonly referred to as a full magnetic quad doublet. However, using a full magnetic quad doublet increases the complexity and cost of the CRT deflection system. There are two main disadvantages to using a full magnetic quad doublet to correct spot distortion. The full magnetic quad doublet requires four separate dynamically driven quadrupole coils: Q1XY, Q145, Q2XY, and Q245. In addition, high power drive circuits are needed to energize the quadrupole coils. The function of each of the four quadrupole coils is as follows:

1. Dynamic Q245 corrects spot elongation along the diagonals of the CRT screen.
2. Dynamic Q145 corrects spot astigmatism along the diagonals of the CRT screen.
3. Dynamic Q2XY corrects spot elongation along the axes of the CRT screen.
4. Dynamic Q1XY corrects spot astigmatism along the axes of the CRT screen.

The correction current waveforms which drive the quadrupole coils of the full magnetic quad doublet are complex and include frequencies proportional to both the horizontal and vertical scan rates of the CRT. The full magnetic quad doublet also requires high power drive circuits when used on CRT displays with high scanning rates.

The full magnetic quad doublet requires high frequency drive signals, which limits the positioning of the quadrupole coils relative to the metal grids in the CRT electron gun. FIG. 11 illustrates the positioning of components in a conventional CRT including a full magnetic quad doublet. A stigmator 100 includes quadrupole coils which are driven by a high frequency signal and must be placed away from the metal grids G3 and G4 in the electron gun. As shown in FIG. 11, the stigmator 100 is positioned away from grid G3 by a distance X. In an exemplary embodiment, X is 0.4". Unless the electron gun is far enough away, electromagnetic fields produced by the neck-mounted stigmator 100 encroach upon the CRT electron gun. A longer gun seal length Y is required to prevent the horizontal deflection rate high frequency magnetic fields generated by the stigmator 100 from interfering with metal grids G3 and G4. In an exemplary embodiment, the distance Y equals 6.88". The long length Y increases the spot size on the CRT screen and decreases image resolution.

SUMMARY OF THE INVENTION

A first embodiment of the invention is a deflection yoke for correcting distortion of an electron beam generated spot along the diagonals of a monochrome cathode ray tube screen. The yoke has a yoke entrance region including harmonic windings configured to produce a barrel-shaped deflection field at the yoke entrance region which overfocuses the electron beam in a direction perpendicular to the direction of the distortion along the diagonals of the screen. A yoke exit region includes harmonic windings configured to produce a pincushion-shaped deflection field at the yoke exit region which overfocuses the electron beam in a direction parallel to the direction of the distortion along the diagonals of the screen to correct the distortion of the spot on the screen generated by the electron beam.

A second embodiment of the invention is a deflection apparatus for correcting distortion of an electron beam generated spot on a monochrome cathode ray tube. The electron beam that generates the spot on the screen has a horizontal scan rate and a vertical scan rate. The apparatus includes a stigmator including horizontal quadrupole coils for correcting spot astigmatism of the electron beam along the axes of the cathode ray tube. The stigmator is coupled to receive signals at the vertical scan rate to the relative exclusion of signals at the horizontal scan rate. A yoke has a yoke entrance region including harmonic windings for producing a barrel-shaped deflection field at the yoke entrance region which overfocuses the electron beam in a direction perpendicular to the direction of the distortion along the diagonals of the screen. The yoke has an exit region including vertical quadrupole coils for correcting spot elongation of the electron beam along the diagonals of the cathode ray tube. Because the vertical quadrupole coil is powered by a low amplitude signal at horizontal and vertical scan rates, it can be digitally controlled to fine-tune the image resolution. In addition, the stigmator is powered by a low power vertical scan rate signal and may be placed adjacent to metal grids within the electron gun. This reduces the overall length of the CRT and improves image resolution.

A third embodiment of the invention is a deflection apparatus for correcting distortion of an electron beam generated spot along the diagonals of a monochrome cathode ray tube. The apparatus includes a deflection yoke with a yoke entrance region including vertical quadrupole coils for correcting spot astigmatism of the electron beam along the diagonals of the cathode ray tube screen. The yoke has a yoke exit region including harmonic windings for producing pincushion-shaped deflection fields at the yoke exit regions which overfocuses the electron beam in a direction parallel to the direction of the spot elongation along the diagonals of the screen. Because the vertical quadrupole coil is powered by a low amplitude signal at vertical scan rates, it can be digitally controlled to fine-tune the image resolution.

DETAILED DESCRIPTION

Figure 1:
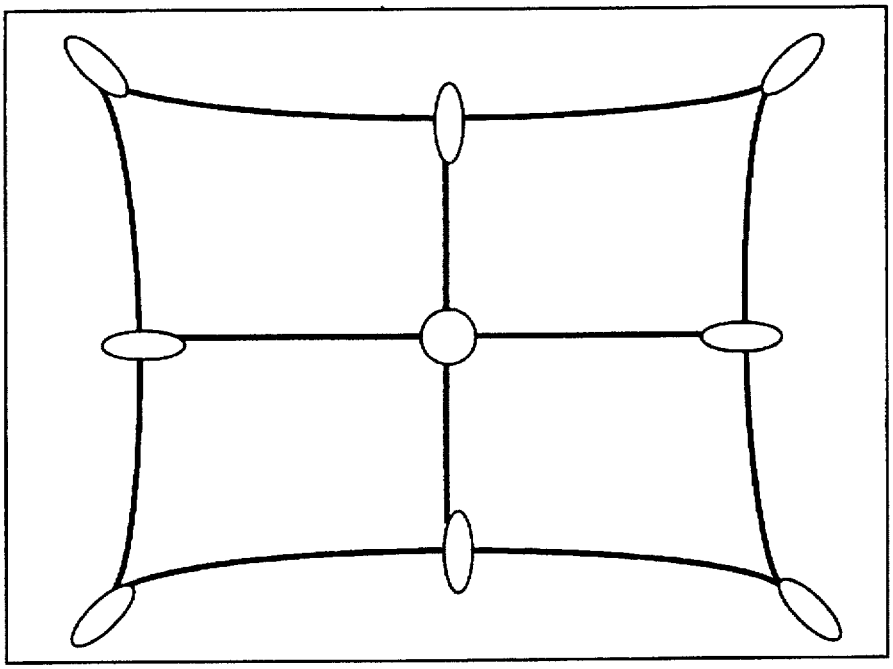
FIG. 1 PRIOR ART
FIG. 1 is a drawing of an image produced by a CRT which illustrates the spot distortion in a conventional CRT without spot correction.
Figure 2:
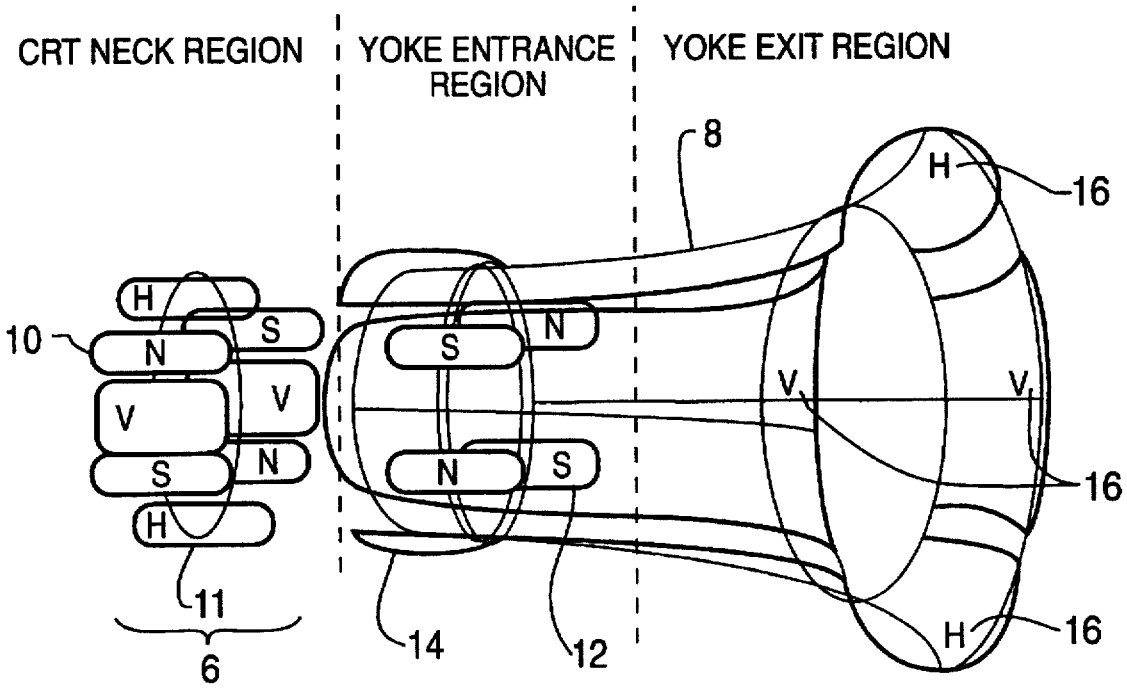
FIG. 2 is a perspective view of a yoke for a CRT which illustrates a spot distortion correction apparatus in a first embodiment of the invention.

FIG. 2 illustrates a spot-correction yoke system requiring 50% fewer dynamic correction circuits than the full magnetic quad doublet system. This reduction in required dynamic correction circuits is achieved by performing spot correction using harmonic windings on the yoke 8. The yoke system requires only two dynamically driven quadrupole coils 10 (Q1XY) and 12 (Q2XY), located on the CRT neck and on the yoke, respectively, to correct spot astigmatism and spot elongation, respectively, along the axes of the screen.

Stigmator assembly 6 includes quadrupole coils 10 for correcting spot astigmatism along the axes (Q1XY), and horizontal and vertical 6-pole (hexpole) coils 11 for correcting coma distortion. These coils are powered by the yoke scan currents. The hexpole coils 11 included in the stigmator assembly 6 produce coma-correcting magnetic fields prior to the entrance region of the yoke 8 to generate spots which are free of coma distortion. The coils 11 are driven in series with the main deflection yoke 8 coils and do not require separate dynamic waveforms.

The dynamically powered quadrupole coils 12 for correcting spot elongation along the axes of the CRT screen (Q2XY) are positioned in the yoke entrance region. The quadrupole coils 10 and the quadrupole coil 12 combine to correct both spot astigmatism and spot elongation along the axes of the CRT. The spot correction along the diagonals of the CRT is performed by the horizontal and vertical harmonic windings 14 in the yoke entrance region and horizontal and vertical harmonic windings 16 in the yoke exit region.

The horizontal and vertical harmonic windings 14 of the yoke 8 produce a deflection field having a high harmonic component in the entrance region to generate non-uniform fields which are barrel-shaped for both the horizontal and vertical deflection to statically correct spot astigmatism along the diagonals of the CRT screen, thus eliminating the need for dynamic Q145. In an exemplary embodiment, the windings 14 produce a deflection field having a negative third harmonic component. The windings 14 extend into the entrance region of the yoke where the barrel-shaped fields have little effect in degrading raster pincushion distortion.

Figure 3:
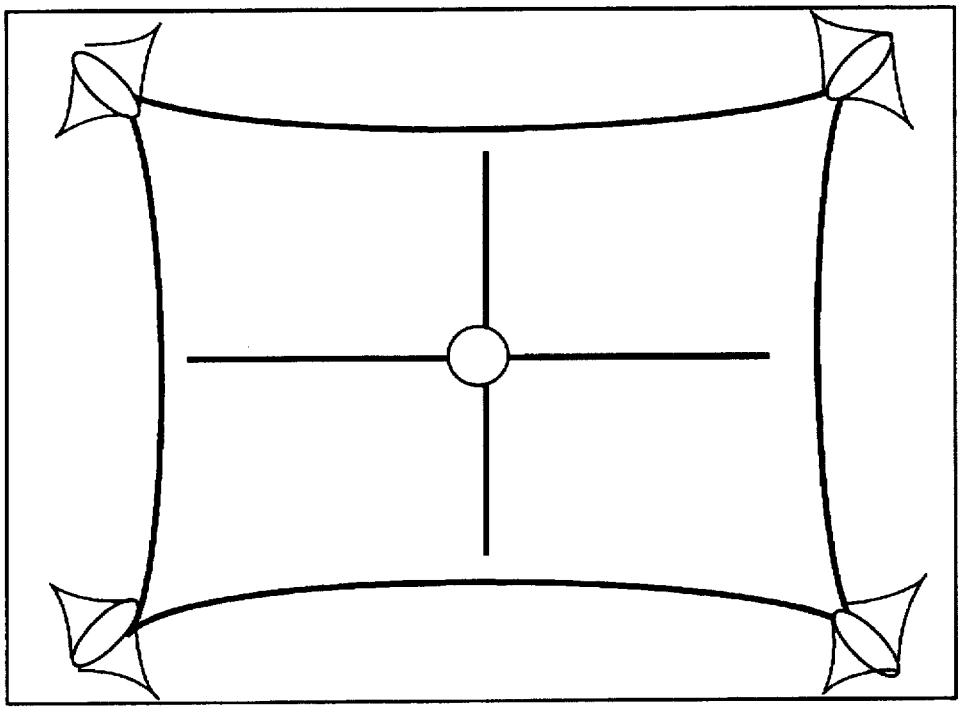
FIG. 3 is a drawing of an image produced by a CRT which illustrates the effect of the harmonic windings in the entrance region of the yoke shown in FIG. 2 on the CRT spot.

FIG. 3 illustrates the barrel shaped field produced by the windings 14 in the yoke 8 entrance region. The barrel-shaped field corrects spot astigmatism by overfocusing the beam in a direction perpendicular to the diagonals of the screen.

Referring to FIG. 2, horizontal and vertical harmonic windings 16 in the exit region of yoke 8 produce a pincushion-shaped field including a higher harmonic component for reducing spot elongation along the diagonals of the CRT screen, and reducing raster pincushion distortion. In an exemplary embodiment, the horizontal and vertical harmonic windings 16 produce a deflection field having a positive third harmonic component. The horizontal and vertical harmonic windings 16 statically correct spot elongation along the diagonals of the CRT screen, thus eliminating the need for dynamic Q245.

Figure 4:
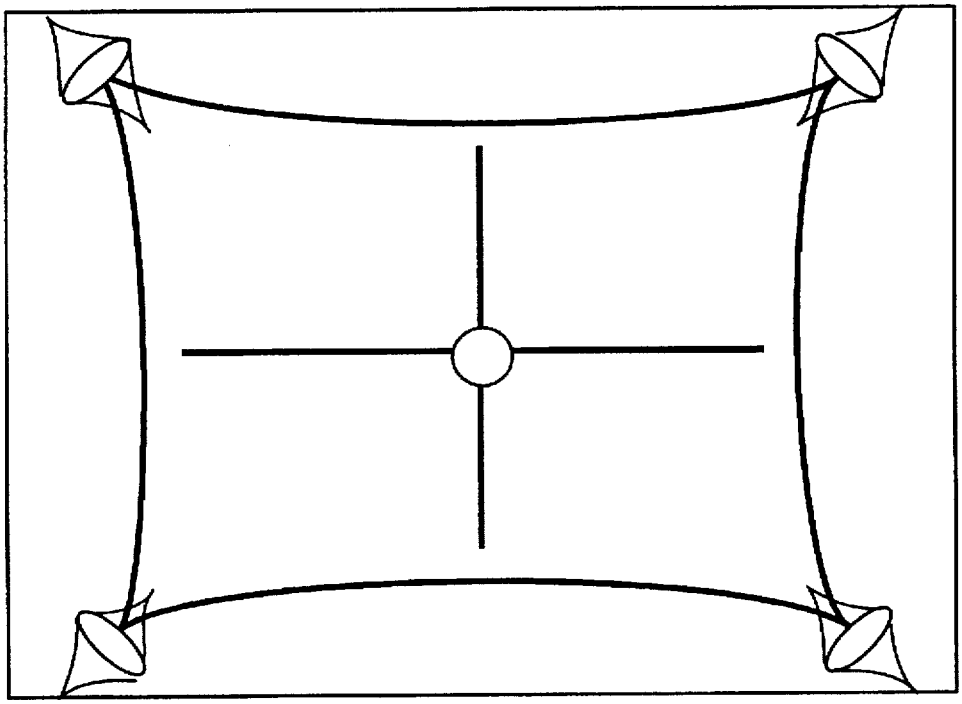
FIG. 4 is a drawing of an image produced by a CRT which illustrates the effect of the harmonic windings in the exit region of the yoke shown in FIG. 2 on the CRT spot.

FIG. 4 illustrates the pincushion-shaped fields produced by the horizontal and vertical harmonic windings 16 in the exit region of yoke 8 (shown in FIG. 2). This field reduces spot elongation by overfocusing the beam in a direction parallel to the diagonals of the screen. The horizontal and vertical harmonic windings 16 extend into the exit region of the yoke 8 where the pincushion-shaped fields are also effective in reducing raster pincushion distortion.

Figure 5:
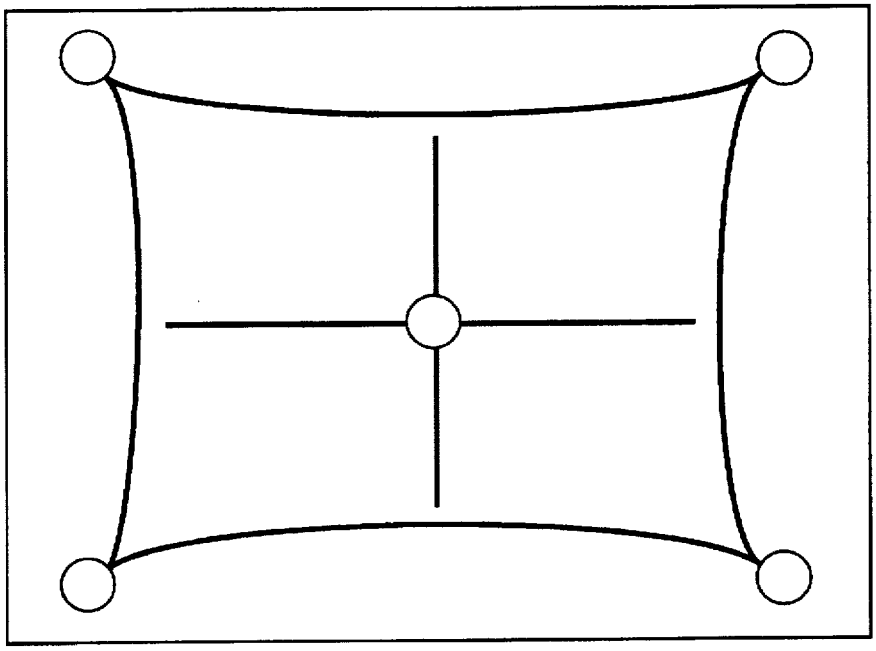
FIG. 5 is a drawing of an image produced by a CRT which illustrates the combined effect of the apparatus shown in FIG. 2 on the CRT spot.

FIG. 5 illustrates the combined effect of the barrel-shaped entrance field generated by the windings 14 in the entrance region of yoke 8 and the pincushion-shaped exit fields generated by the horizontal and vertical harmonic windings 16 in the exit region of yoke 8. The two fields are balanced to reduce spot elongation and astigmatism as depicted in FIG. 5. The windings at the entrance region and exit region of the yoke are described in Tables 1 and 2.

TABLE 1

Winding at the yoke entrance region for the first embodiment.

| Slot | 1 | 2 | 3 | 4 | 5 | 6 | |
|---|---|---|---|---|---|---|---|
| Angle 7.5 (degrees) | 22.5 | 37.5 | 52.5 | 67.5 | 82.5 | | |
| | | | | | | | Total turns |
| H-entrance | 1 | 2 | 2 | 2 | 1 | 0 | 8.00 |
| V-entrance | 2 | 5 | 5 | 7 | 7 | 6 | 32.00 |

TABLE 2

Windings at the yoke exit region for the first embodiment.

| Slot | 1 | 2 | 3 | 4 | 5 | 6 | |
|---|---|---|---|---|---|---|---|
| Angle (degrees) | 7.5 | 22.5 | 37.5 | 52.5 | 67.5 | 82.5 | |
| | | | | | | | Total turns |
| H-exit | 3 | 3 | 2 | 0 | 0 | 0 | 8.00 |
| V-exit | 0 | 2 | 2 | 7 | 10 | 11 | 32.00 |

Figure 6:
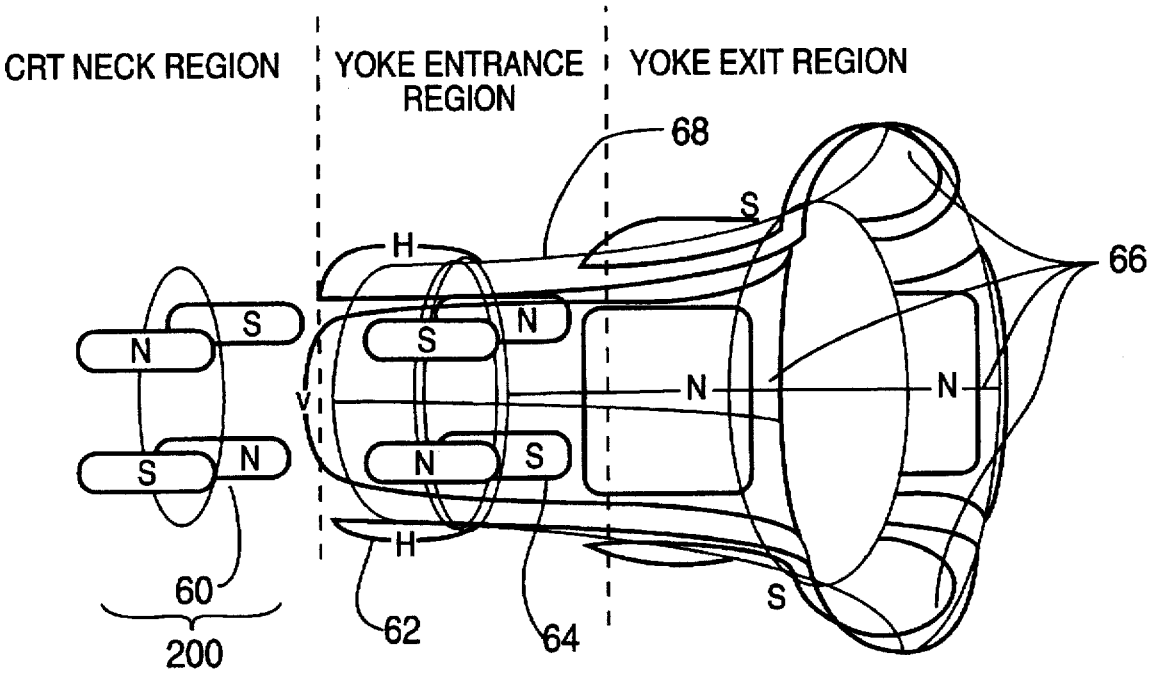
FIG. 6 is a perspective view of a CRT yoke which illustrates a spot distortion correction apparatus in a second embodiment of the invention.

FIG. 6 is a perspective view of a second embodiment of the invention. A stigmator 200 includes horizontal quadrupole coils 60 for correcting spot astigmatism along the axes of the CRT screen (Q1XY). The quadrupole coils 60 are powered dynamically, predominantly at low-power vertical scan rate. Horizontal and vertical harmonic windings 62 produce a deflection field having a higher harmonic component to a create barrel-shaped deflection field for correcting spot astigmatism along the diagonals of the CRT screen (Q145). In an exemplary embodiment, the harmonic windings 62 produce a deflection field having a negative third harmonic component. The horizontal and vertical harmonic windings 62 are positioned in the entrance region of yoke 68. Quadrupole coils 64 for correcting spot elongation along the axes of the CRT screen (Q2XY) are powered dynamically at low-power vertical scan rate. Quadrupole coils 66 for correcting spot elongation along the diagonals of the CRT screen (Q245) are powered dynamically at low-amplitude horizontal scan rates modulated by vertical scan rates. Because the vertical quadrupole coil 66 is powered by a low amplitude signal at horizontal and vertical scan rates, it can be digitally controlled to fine-tune the image resolution.

The horizontal and vertical harmonic windings 62 statically eliminate astigmatism of spots along the diagonals of the CRT screen while the vertical quadrupole coils 66 are driven dynamically to create a converging lens to reduce diagonally-directed elongation of the corner spots. Only three dynamically driven quadrupole coils (60, 64 and 66) are required for controlling distortion of spots deflected anywhere on the CRT screen. Spot coma distortion is negligible and does not require separate coma-correcting coils such as the hexpole coils 11 (shown in FIG. 2) used in the first embodiment.

The horizontal and vertical harmonic windings 62 of the main yoke 68 generate non-uniform fields which are barrel-shaped for both the horizontal and the vertical deflection to statically introduce modest spot astigmatism along the diagonals of the CRT screen. In an exemplary embodiment, the windings 62 produce a negative third harmonic. This eliminates the need for dynamic correction of spot astigmatism along the diagonals of the CRT (Q145). When the beam is deflected along the diagonals of the CRT screen, the windings 62 act as a diverging lens which, when concentrated over the entrance region of the yoke 68, has little effect in degrading raster pincushion distortion.

Figure 7:
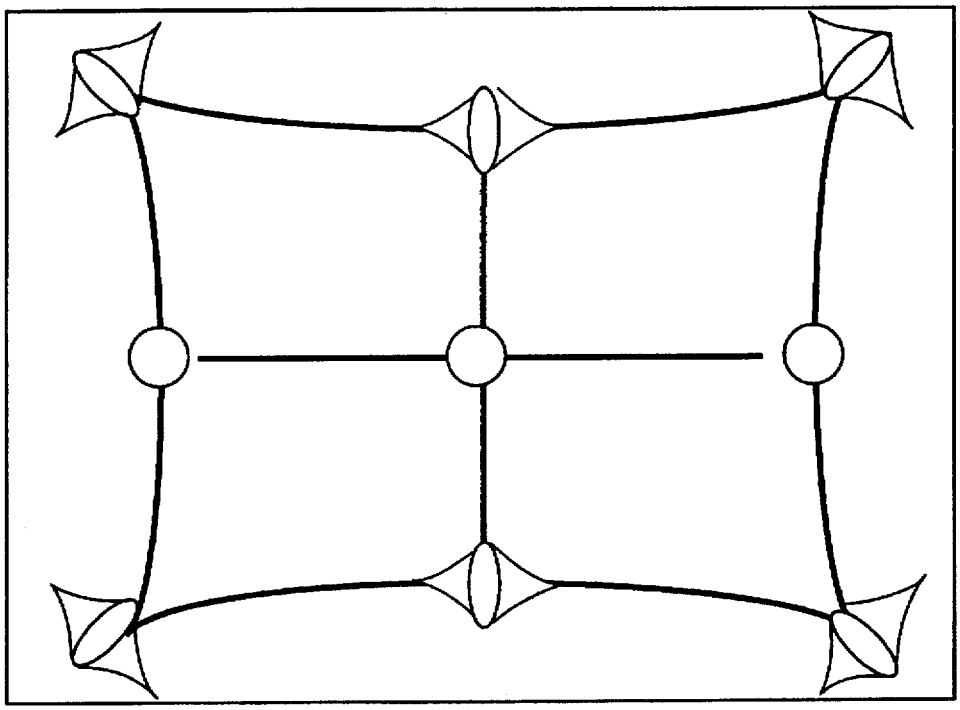
FIG. 7 is a drawing of an image produced by a CRT which illustrates the effect of the harmonic windings in the entrance region of the yoke shown in FIG. 6 on the CRT spot.

FIG. 7 illustrates the effect of the barrel-shaped field produced by the windings 62. The barrel shaped field overfocuses the spot in a direction perpendicular to the diagonals of the screen and statically introduces spot astigmatism.

The quadrupole correction coils 66 added to the main yoke 68 exit region produce even harmonics with respect to the magnetic deflection field of the windings 62 of the main yoke. The quadrupole coils 66 are driven dynamically to generate vertical even harmonics (V2nd) in the yoke exit region which superpose with the field produced by the main horizontal and vertical harmonic windings. This creates a non-uniform deflection field that forms a converging lens which corrects spot elongation along the diagonals of the CRT screen.

Figure 8:
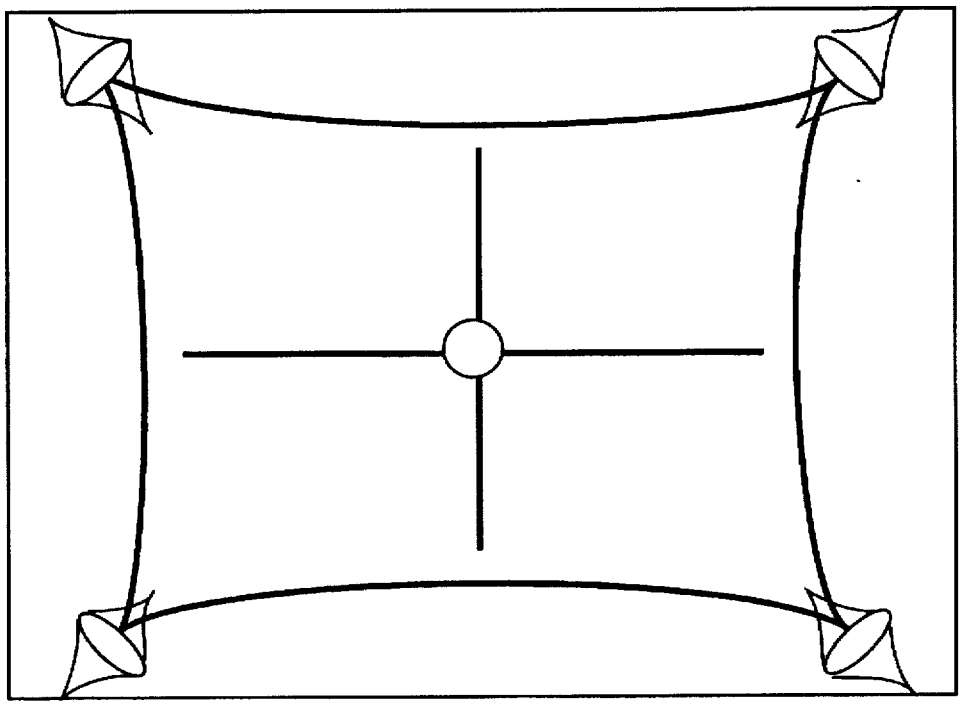
FIG. 8 is a drawing of an image produced by a CRT which illustrates the effect of the quadrupole correction coils in the yoke exit region in FIG. 6 on the CRT spot.

FIG. 8 illustrates the field produced by the quadrupole coils 66 at the yoke 68 exit region. This field reduces spot elongation by overfocusing the beam in a direction parallel to the diagonals of the screen. The quadrupole coils 66 extend into the exit region of the yoke 68 where their fields form a converging lens which is also effective in reducing raster pincushion distortion.

Figure 9:
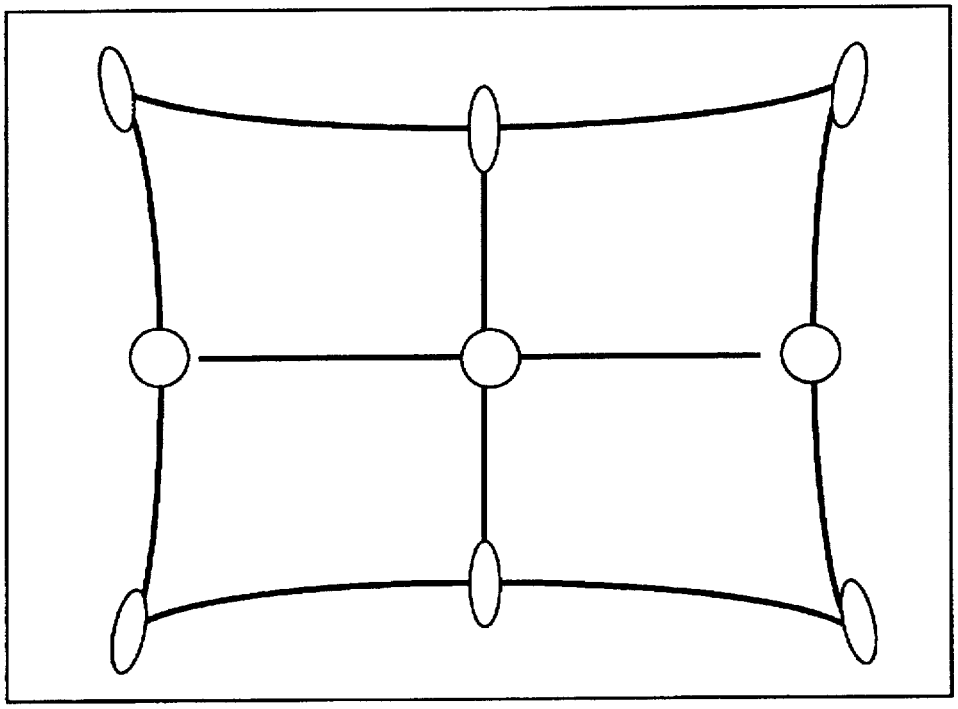
FIG. 9 is a drawing of an image produced by a CRT which illustrates the combined effect of the harmonic windings and the quadrupole correction coils in the yoke exit region shown in FIG. 6 on the CRT spot.

The combined effect of the windings 62 and the quadrupole correction coils 66 is shown in FIG. 9. The diverging lens effects of the barrel-shaped entrance fields of the main yoke 68 combined with the converging lens effects of the exit region V2nd quadrupole fields are balanced to reduce diagonal spot elongation and eliminate diagonal spot astigmatism of corner spots.

Figure 10:
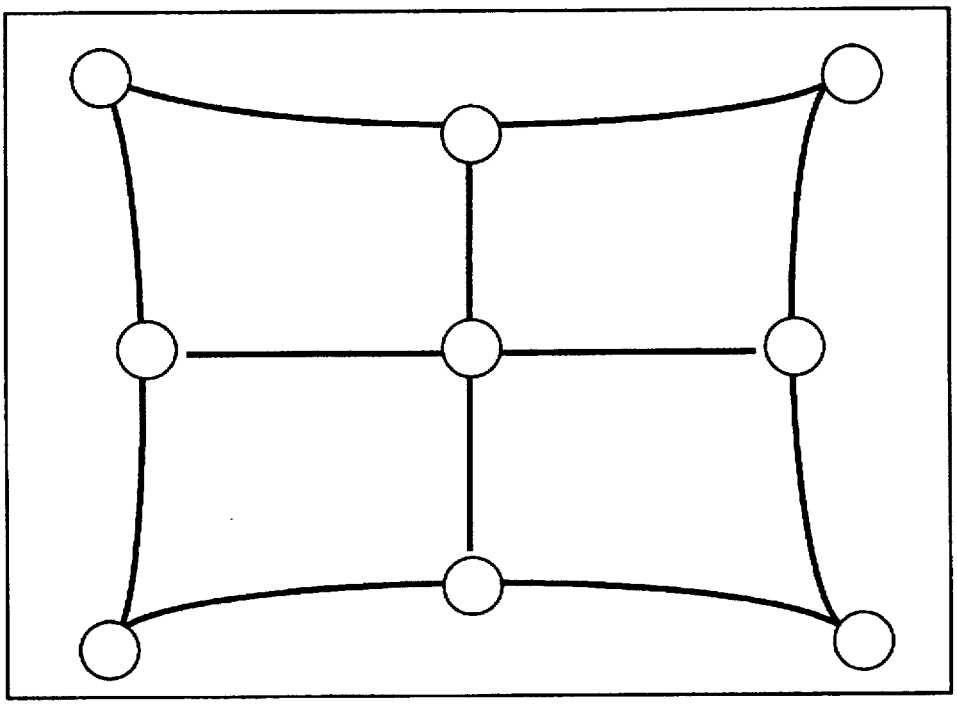
FIG. 10 is a drawing of an image produced by a CRT which illustrates the effect of the spot distortion correction apparatus shown in FIG. 6.

FIG. 10 illustrates a fully spot-corrected CRT. The distortion along the axes of the CRT is corrected by the quadrupole coils 60 and the quadrupole coils 64 (both shown in FIG. 6). The drive power requirements of the dynamic correction circuits is dramatically reduced relative to a yoke with a full magnetic quad doublet by virtue of eliminating the need to operate at the horizontal scan frequency. The invention requires only three low-power dynamically driven quadrupole coils 60 (Q1XY), 64 (Q2XY), and 66 (Q245) located on the CRT neck, on the yoke entrance region, and on the yoke exit region, respectively. These quadrupole coils, in combination with the windings 62, correct spot astigmatism and spot elongation everywhere on the CRT screen. These quadrupole coils (60, 64, and 66) are driven dynamically with low-power vertical-rate parabola-shaped currents and eliminate vertical elongation and astigmatism of the spots along top and bottom edges of the CRT screen. The windings at the entrance region of the yoke are described in Table 1 above.

Figure 11:
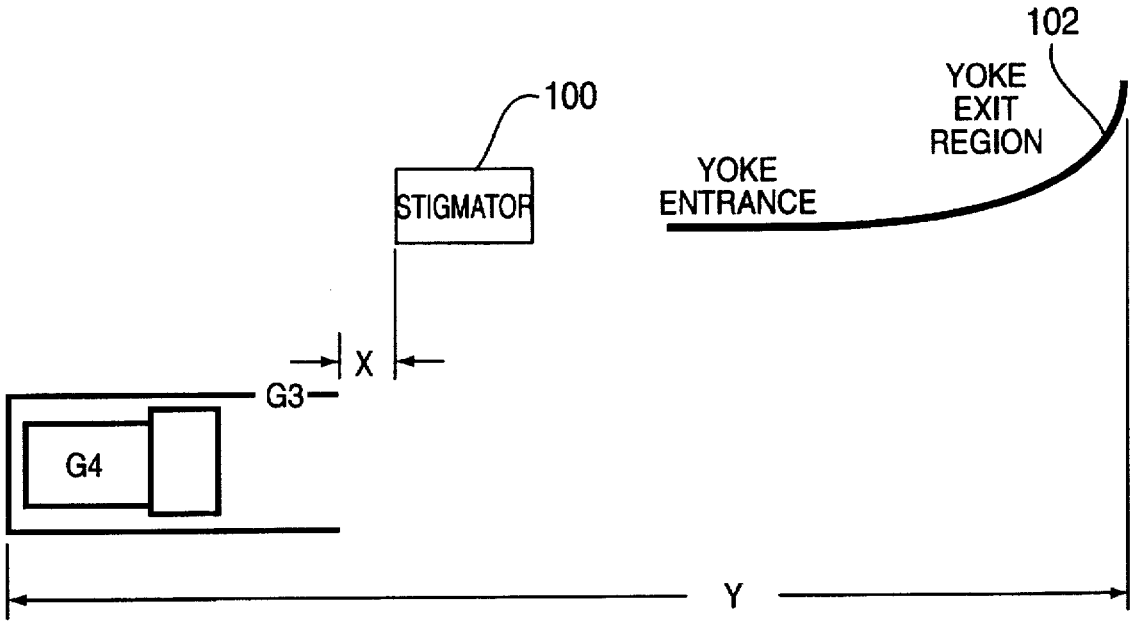
FIG. 11 PRIOR ART
FIG. 11 is a side plan view of a CRT and yoke which illustrates the positioning of certain components of a conventional CRT.
Figure 12:
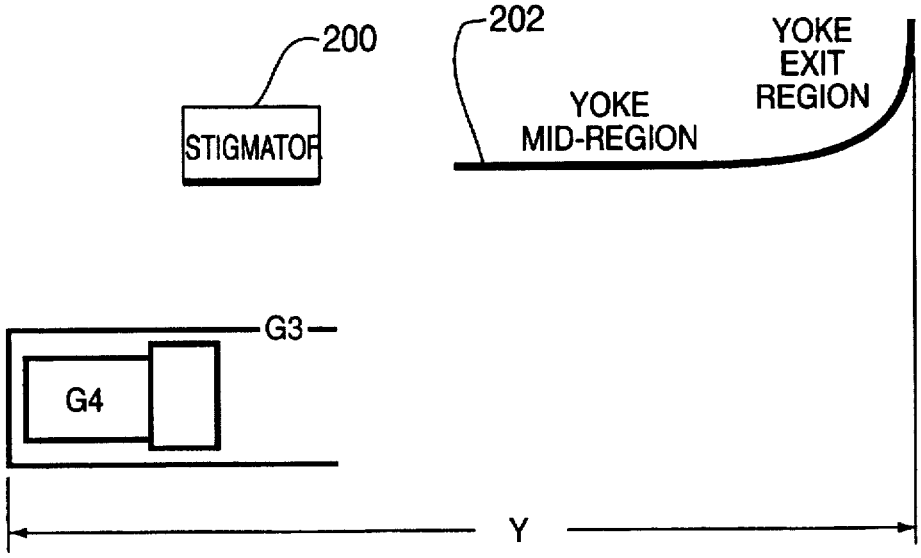
FIG. 12 is a side plan view of a CRT and yoke which illustrates the positioning of the certain components of a CRT using the spot distortion correction apparatus of FIG. 6.

FIG. 12 illustrates the positioning of the stigmator 200 shown in FIG. 6 with respect to the metal grids G3 and G4 of the electron gun of the CRT. The stigmator 200 includes quadrupole coils 60 which are driven at a low-power vertical scan rate. Residual x-y astigmatism of horizontally deflected spots is corrected by adding the horizontal frequency to the current waveform driving yoke-mounted quadrupole coils 64 (Q2XY) rather than adding horizontal frequency to the current waveform driving the neck-mounted quadrupole coils 60 (Q1XY). This eliminates high-frequency drive from the neck-mounted quadrupole coils 60. As shown in FIG. 12, the stigmator 200, including quadrupole coils 60, can be placed adjacent to the metal grids G3 and G4. Because the quadrupole coils 60 are driven at the lower vertical frequency, the stigmator 200 does not produce electromagnetic fields that interfere with the metal grids G3 and G4 to degrade the electron gun performance. This reduces the gun seal-length Y and results in a significantly reduced spot size on the face of the CRT. In an exemplary embodiment, Y is equal to 5.38". This reduced length enhances the resolution of the CRT and allows the CRT to be mounted in a smaller cabinet than if the arrangement shown in FIG. 11 were used.

Figure 13:
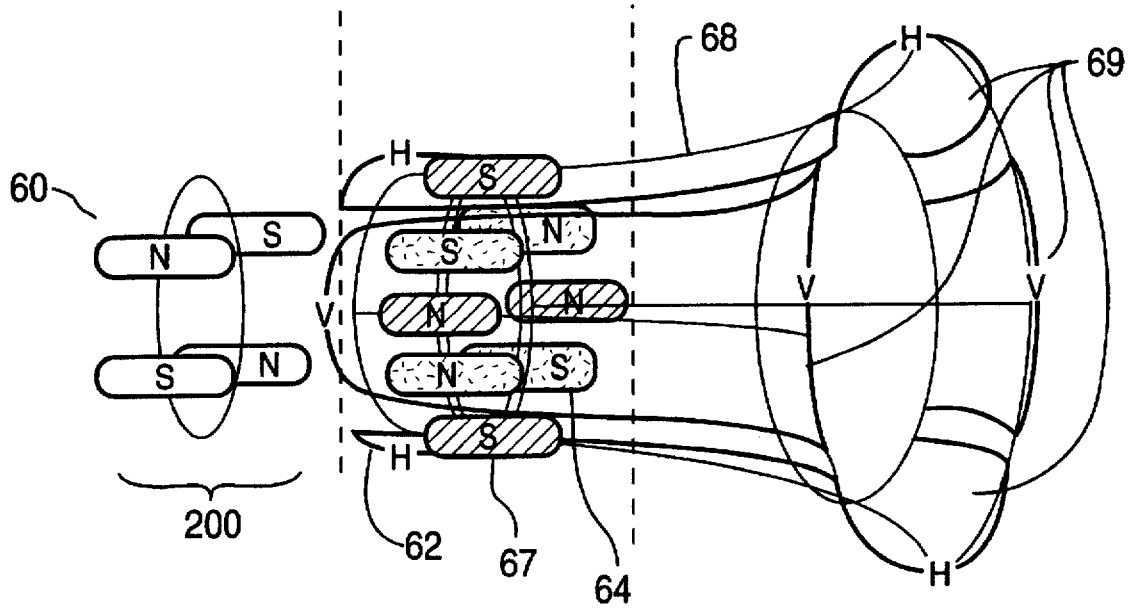
FIG. 13 is a perspective view of a CRT yoke which illustrates a spot distortion correction apparatus in a third embodiment of the invention.

FIG. 13 illustrates a third embodiment of the invention. The third embodiment is similar to the second embodiment shown in FIG. 6 except that the vertical quadrupole coils 66 are removed from the exit region of yoke 68. Vertical quadrupole coils 67 are positioned, instead, at the entrance region of the yoke 68 and correct spot astigmatism of the electron beam along the diagonals of the cathode ray tube. Horizontal and vertical harmonic windings 69 are positioned in the yoke exit region which overfocus the electron beam in a direction parallel to the direction of the spot elongation along the diagonals of the screen. The harmonic windings 69 in the exit region of the yoke 68 are described above in Table 2. Because the vertical quadrupole coils 67 are powered by a low amplitude signal at horizontal and vertical scan rates, it can be digitally controlled to fine-tune the image resolution.

Figure 14:
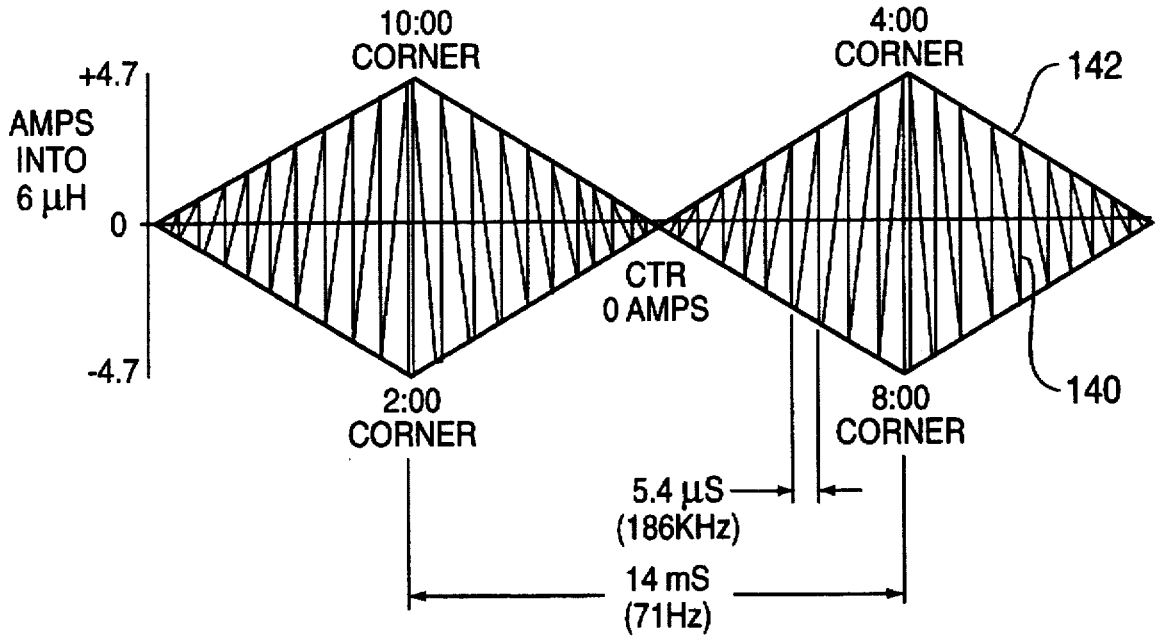
FIG. 14 is a waveform diagram of a low amplitude horizontal deflection signal modulated by a vertical deflection signal.

FIG. 14 is a waveform diagram illustrating a horizontal deflection signal 140 modulated by a vertical deflection signal 142. This signal is used to drive the vertical quadrupole coils 66 in FIG. 6 and the vertical quadrupole coils 67 in FIG. 13.

To derive the harmonic winding distributions on the yoke, an experimental yoke was used to simulate and determine turns distributions for horizontal and vertical deflection coils of a deflection yoke that produces a statically pin-free raster and statically-corrected (distortion-free) deflected corner beam spots on a portrait-mode 19-inch 90o CRT.

The experimental deflection yoke contains multiple windings to produce fundamental-only horizontal and vertical deflecting magnetic fields as well as separately controllable 3rd-harmonic Fourier components of the horizontal and vertical deflecting fields. Further, the 3rd-harmonic component fields of both the horizontal and vertical coils are separately controllable at two regions located at the entrance and at the exit halves of the deflection yoke depicted in FIG. 15. The slotted stator yoke core includes annular slot A for transitioning between different turns distributions within a single winding. The z-axis position of annular slot A is chosen to achieve the desired balance in compensating effects of the entrance and exit regions. In total, six (6) separately controlled windings are available for simulating a conceptual deflection yoke which, in practice, requires only two coil windings, one each for horizontal and vertical deflection.

Figure 15:
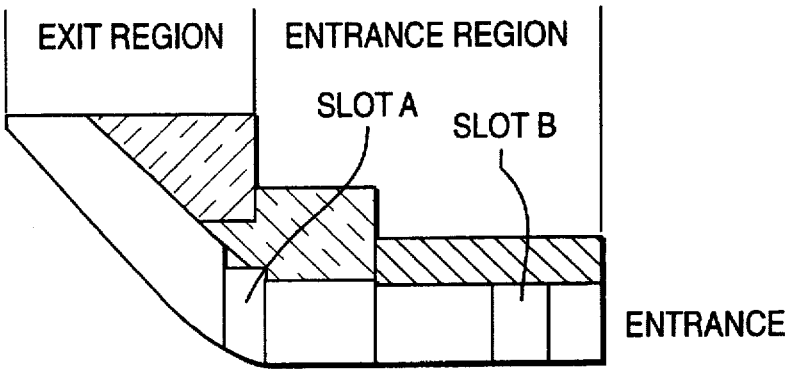
FIG. 15 is a detailed view of a slotted stator yoke used in an exemplary embodiment of the invention.

FIG. 15 shows a deflection yoke core of an exemplary embodiment of the invention. The core features annular slot A for crossing wire turns between bundles located in separate radial slots differing by angular position. In the invention, the z-axis position of slot A determines the balance between raster pincushion-distortion and spot distortion. Alternatively, a smooth core yoke may be used instead of the slotted core.

Figure 16:
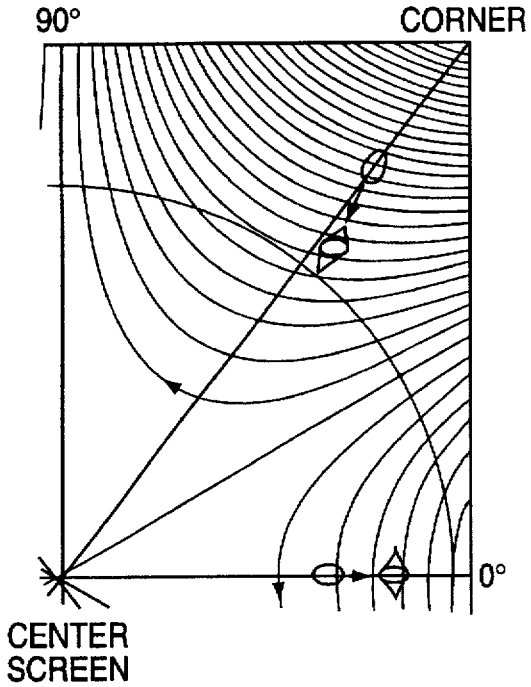
FIG. 16 is a two-dimensional magnetic field graph which illustrates the horizontal third harmonic magnetic field lines for the upper right hand quadrant of the CRT screen.
Figure 17:
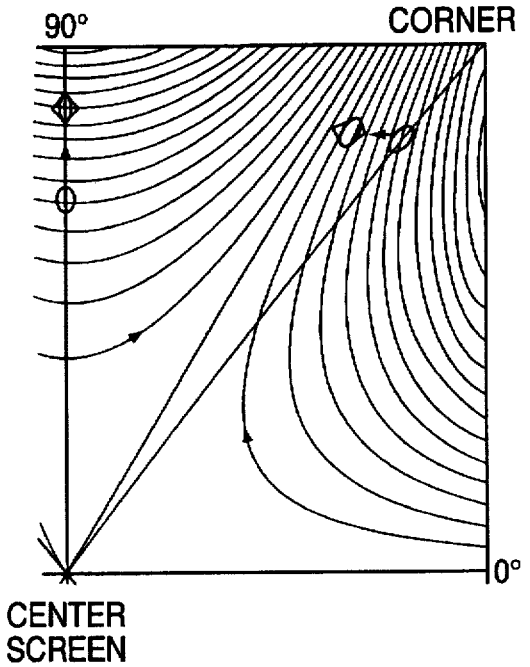
FIG. 17 is a two-dimensional magnetic field graph which illustrates the vertical third harmonic magnetic field lines for the upper right hand quadrant of the CRT screen.

FIGS. 16 and 17 illustrate the horizontal and vertical 3rd harmonic magnetic field lines for the upper right hand quadrant of the CRT screen, respectively. The non-uniformity of the horizontal and vertical magnetic deflection fields are defined by the direction and magnitude of the 3rd harmonic content. The third harmonic field lines affect the relative position and astigmatism of the deflected beam spot as depicted in FIGS. 16 and 17. The effects of the 3rd harmonic components of the magnetic deflecting field were observed in the laboratory to be as follows:

1. Increasing the current ratio exit H3:1 reduces side pincushion distortion of the raster and reduces top/bottom pincushion distortion of the raster. Increasing exit H3:1 ratio also creates a pin-shaped horizontal deflecting field which overfocuses the corner beam spot in a direction substantially parallel to the screen diagonal, thus reducing the elongation of the deflected corner spot when the spot is made anastigmatic by astigmatism-correcting means.
2. Increasing the current ratio exit V3:1 reduces side pincushion distortion of the raster, but increases top/bottom pincushion distortion of the raster.
3. Increasing the current ratios entrance H3:1 and entrance v3:1 reduces and substantially eliminates spot astigmatism caused by ratios exit H3:1 and exit V3:1; therefore, entrance H3:1 and entrance V3:1 ratios are considered to act suitably as spot astigmatism-correcting means.

A new yoke design according to an exemplary embodiment of the invention, that produces static diagonal spot shape and astigmatism correction and pin-free raster on 19V90 portrait CRT, was simulated experimentally using the experimental yoke. The measured currents and turns distributions were used to calculate a composite winding distribution manufacturable in a single coil. The measured data, the analysis, and the resulting coil turns distributions for an exemplary embodiment of the invention are summarized in Table 3. In Table 3, a negative number represents a coil in which current flows in a direction opposite to the current flow in a positive numbered coil. This opposite current flow may be achieved by opposite winding directions, such as clockwise vs. counter clockwise. The opposite current flow may also be produced through positive and negative current sources.

TABLE 3

1. Horizontal 3rd (exit) corrects top/bottom and side pincushion, and reduces corner spot elongation.
2. Vertical 3rd (exit) reduces side pincushion.
3. Vcoma and Hcoma (entrance 3rd) together correct corner spot astigmatism.

Experimental coil turns distributions

| Slot | 1 | 2 | 3 | 4 | 5 | 6 | Total turns |
|---|---|---|---|---|---|---|---|
| Angle (degrees) | 7.5 | 22.5 | 37.5 | 52.5 | 67.5 | 82.5 | |
| Hcoma | −2 | −1 | 1 | 2 | 2 | 1 | |
| H3rd | 2 | 1 | −1 | −2 | −2 | −1 | |
| H1 | 2 | 2 | 2 | 1 | 1 | 0 | 8 |
| Vcoma | 1 | 2 | 2 | 1 | −1 | −2 | |

TABLE 3-continued

| | | | | | | | |
|---|---|---|---|---|---|---|---|
| V3rd | −1 | −2 | −2 | −1 | 1 | 2 | |
| V1 | 1 | 4 | 4 | 7 | 8 | 8 | 32 |
| Measured current (amps) required for pin-free raster and anastigmatic corner spots on 19V90 | | | | | | | |
| Hcoma | 1.54 | 1.54 | 1.54 | 1.54 | 1.54 | 1.54 | |
| H3rd | 2.15 | 2.15 | 2.15 | 2.15 | 2.15 | 2.15 | |
| H1 | 5.76 | 5.76 | 5.76 | 5.76 | 5.76 | 5.76 | |
| Vcoma | 1.52 | 1.52 | 1.52 | 1.52 | 1.52 | 1.52 | |
| V3rd | 1.83 | 1.83 | 1.83 | 1.83 | 1.83 | 1.83 | |
| V1 | 2 | 2 | 2 | 2 | 2 | 2 | |
| Calculated amp-turns Total amp turns | | | | | | | |
| Hcoma | −3.08 | −1.54 | 1.54 | 3.08 | 3.08 | 1.54 | |
| H3rd | 4.3 | 2.15 | −2.15 | −4.3 | −4.3 | −2.15 | |
| H1 | 11.52 | 11.52 | 11.52 | 5.76 | 5.76 | 0 | |
| H1 + H3rd | 15.82 | 13.67 | 9.37 | 1.46 | 1.46 | −2.15 | 39.63 |
| H1 + Hcoma | 8.44 | 9.98 | 13.06 | 8.84 | 8.84 | 1.54 | 50.7 |
| Vcoma | 1.52 | 3.04 | 3.04 | 1.52 | −1.52 | −3.04 | |
| V3rd | −1.83 | −3.66 | −3.66 | −1.83 | 1.83 | 3.66 | |
| V1 | 2 | 8 | 8 | 14 | 16 | 16 | |
| V1 + V3rd | 0.17 | 4.34 | 4.34 | 12.17 | 17.83 | 19.66 | 58.51 |
| V1 + Vcoma | 3.52 | 11.04 | 11.04 | 15.52 | 14.48 | 12.96 | 68.56 |
| Calculated new coil distributions | | | | | | | |
| | | | | | | | Total turns |
| H-exit | 3.2 | 2.8 | 1.9 | 0.3 | 0.3 | −0.4 | 8.00 |
| H-entrance | 1.3 | 1.6 | 2.1 | 1.4 | 1.4 | 0.2 | 8.00 |
| V-exit | 0.1 | 2.4 | 2.4 | 6.7 | 9.8 | 10.8 | 32.00 |
| V-entrance | 1.6 | 5.2 | 5.2 | 7.2 | 6.8 | 6.0 | 32.00 |
| Final coil turns distributions of an exemplary embodiment of the invention | | | | | | | |
| | | | | | | | Total turns |
| H-exit | 3 | 3 | 2 | 0 | 0 | 0 | 8.00 |
| H-entrance | 1 | 2 | 2 | 2 | 1 | 0 | 8.00 |
| V-exit | 0 | 2 | 2 | 7 | 10 | 11 | 32.00 |
| V-entrance | 2 | 5 | 5 | 7 | 7 | 6 | 32.00 |

Figure 18:
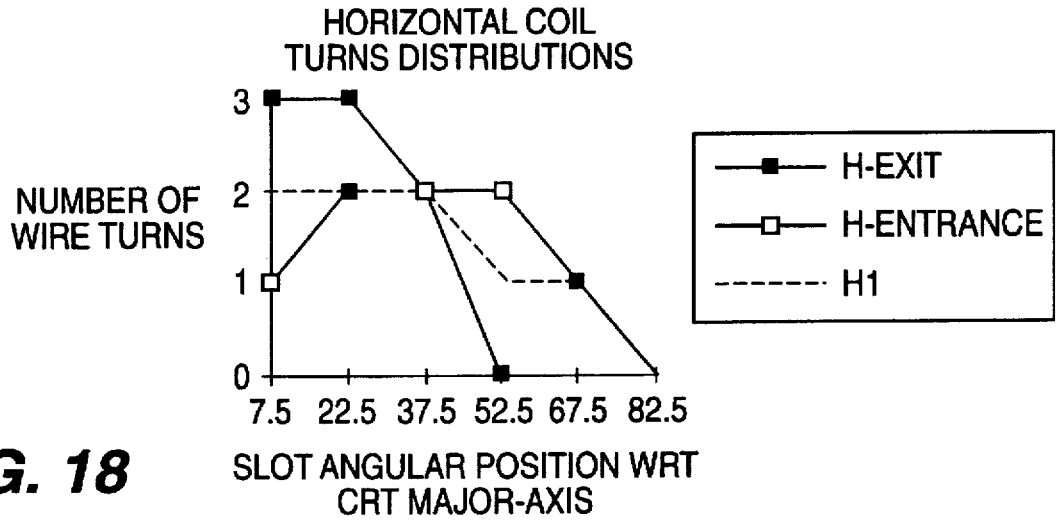
FIG. 18 is a graphical representation of the horizontal coil turns distributions in an exemplary embodiment.
Figure 19:
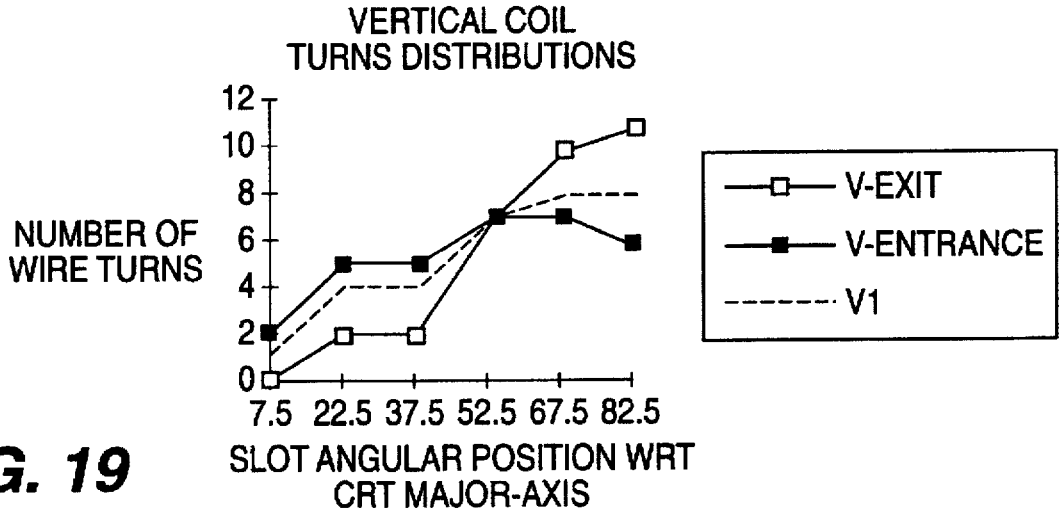
FIG. 19 is a graphical representation of the vertical coil turns distributions in an exemplary embodiment.

FIGS. 18 and 19 graphically represent the final turns distributions shown above in Table 3. The dashed line in FIGS. 18 an 19 represent prior art coil turns distributions. The non-uniform-field horizontal and vertical deflection coil winding distributions of an exemplary embodiment of the invention are compared to prior art coil distributions for producing uniform-field deflection. The non-uniformity of the horizontal and vertical magnetic deflection fields are defined by the direction and magnitude of 3rd harmonic content. The non-uniformity of the magnetic field generated by energizing the coil windings affects the relative position and shape of the deflected beam spot. The yoke is divided into two halves, an entrance region and an exit region, and different winding turns distributions are assigned to each half according to the invention. For this example, each coil entrance and exit half contains the same total number of turns for ease in manufacturing.

Figure 20:
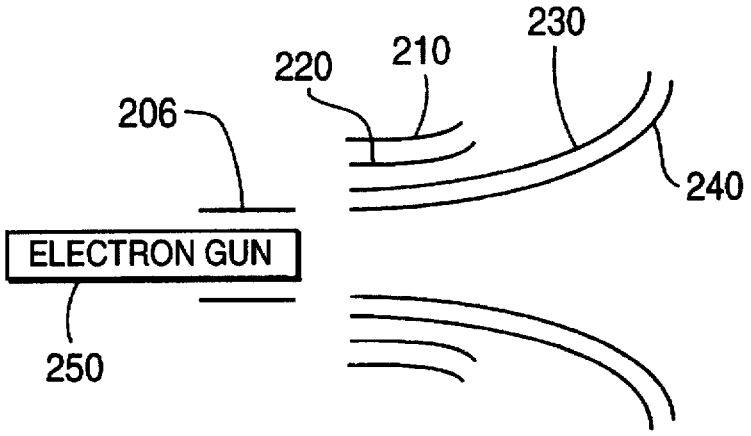
FIG. 20 is a reduced-detail diagram of a yoke which illustrates the positioning of the quadrupole coils, the vertical coil and the horizontal coil.

FIG. 20 illustrates the relative positioning of a Q1xy quadrupole coil 206, a Q2xy quadrupole coil 210, a diagonal quadrupole coil 220, a horizontal coil 230 and a vertical coil 240 with respect to the electron gun 250. The Q1xy quadrupole coil 206 does not interfere with the electron gun 250 performance because the quadrupole coil 206 is driven by a substantially low-frequency-only (frame-rate) dynamic-correction current.

Figure 21:
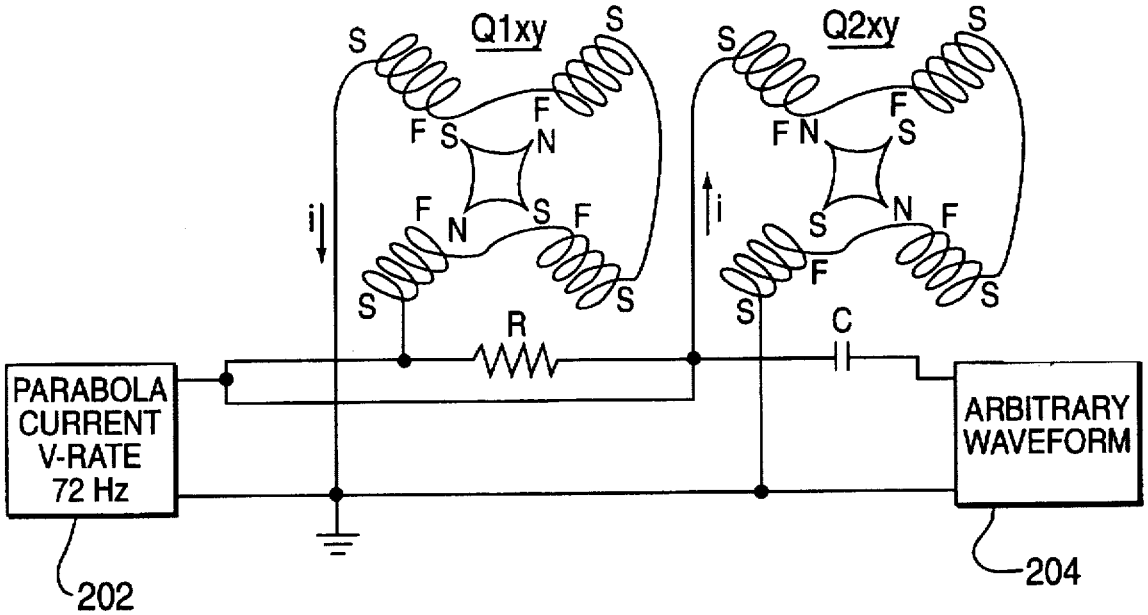
FIG. 21 is a schematic diagram, partly in block diagram form, of the quadrupole coils and associated driving circuitry.
Figure 22:
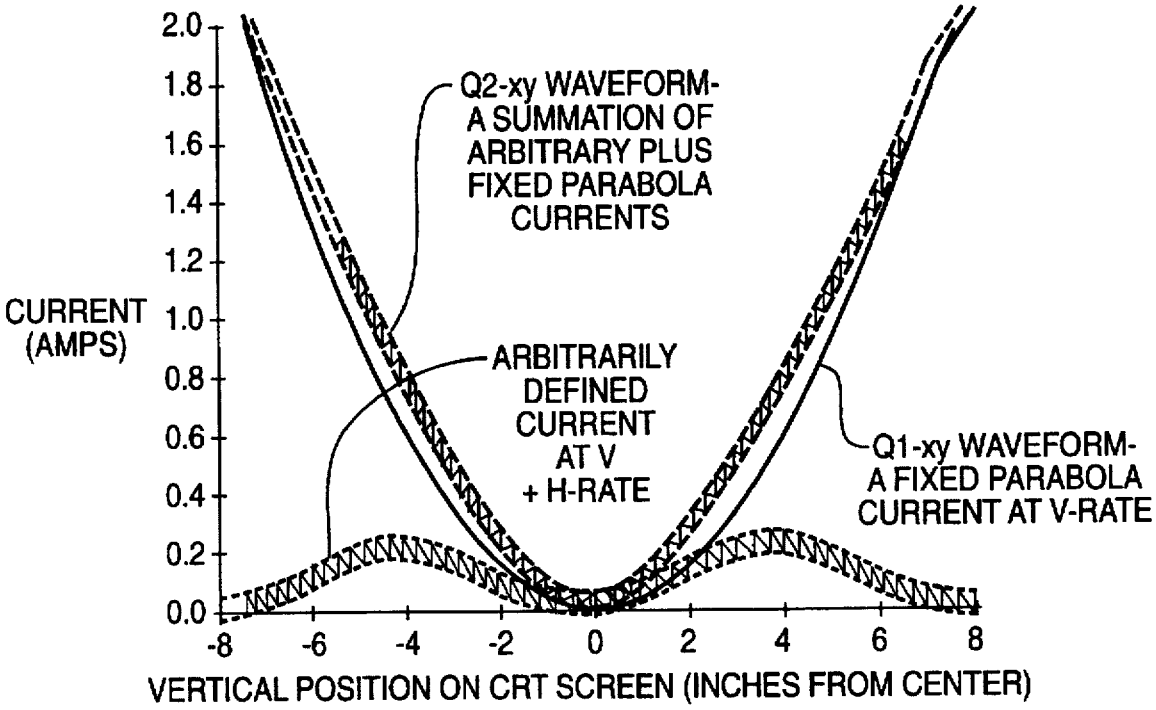
FIG. 22 is a graph of magnetic field versus vertical screen position which illustrates current waveforms produced by the driving circuitry shown in FIG. 21.

FIG. 21 illustrates the Q1xy and Q2xy quadrupole coils and driving circuitry coupled to these coils in an exemplary embodiment of the invention. A parabolic current generator 202 produces a parabolic current which is provided to the Q1xy quadrupole coil. As shown in FIG. 22, the Q1xy quadrupole coil is driven by the fixed parabolic current waveform. The Q2xy quadrupole coil is driven by a combination of the fixed parabolic current waveform produced by waveform generator 202 and an arbitrary waveform produced by arbitrary waveform generator 204. The arbitrary waveform in an exemplary embodiment of the invention is shown in FIG. 22. The arbitrary waveform generator 204 may be implemented using a memory device (e.g. an EEPROM) which stores current values for each position on the screen. The memory device is addressed by horizontal and vertical screen position signals (derived, for example, from the horizontal and vertical deflection signals). The memory device may initially store average values for the arbitrary waveform for each position on the screen. A technician can then observe the distortion of the beam on the screen and adjust the values of the arbitrary waveform stored in the memory device. In this way, an arbitrary current can be derived for any position on the CRT screen.

Figure 23:
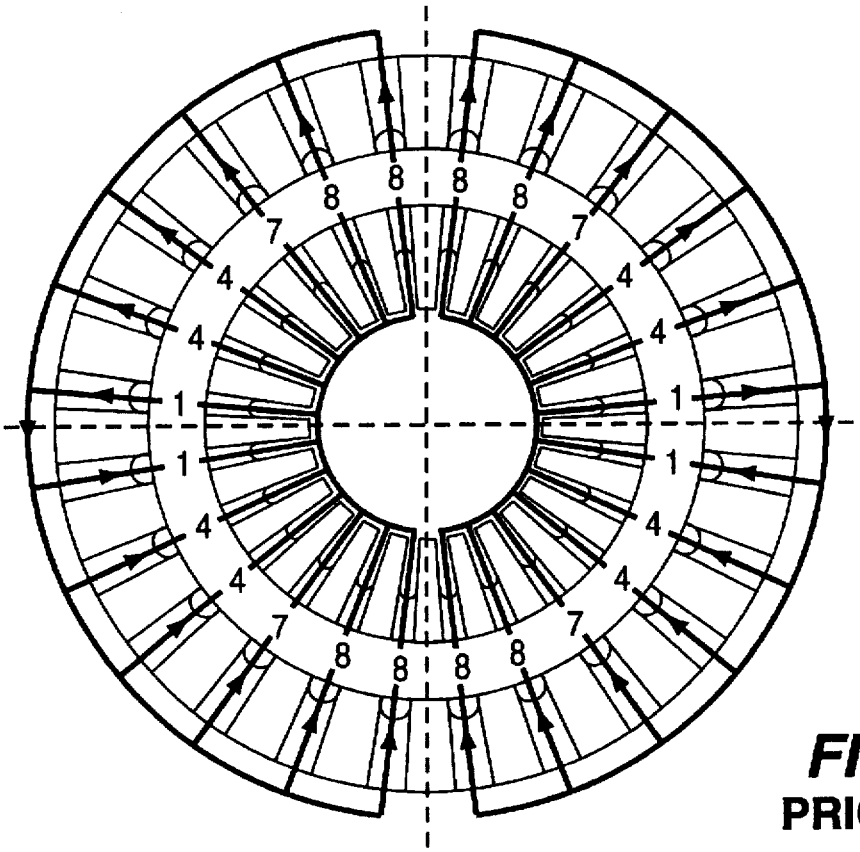
FIG. 23 PRIOR ART
FIG. 23 is a front plan view of a yoke which illustrates the vertical coil turns distribution in a conventional deflection yoke.

FIG. 23 is a graphical illustration of the vertical coil turns distribution for a prior art deflection yoke for generating uniform-field magnetic deflection. The turns distribution contains nearly no Fourier harmonic content above V1st.

Figure 24:
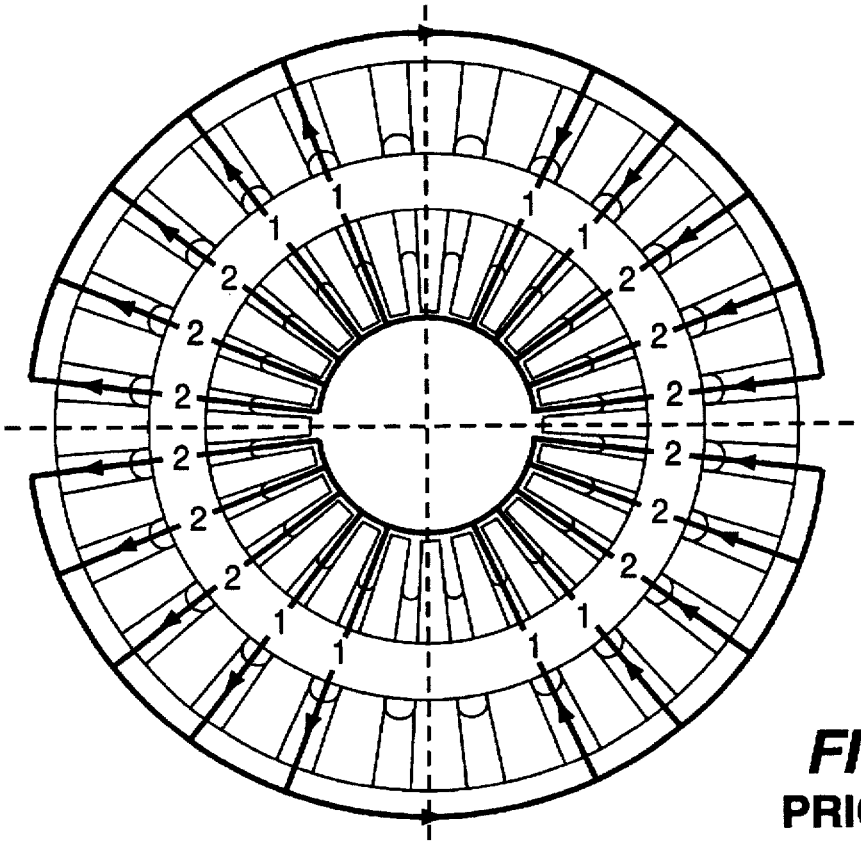
FIG. 24 PRIOR ART
FIG. 24 is a front plan view of a yoke which illustrates the horizontal coil turns distribution in a conventional deflection yoke.

FIG. 24 is a graphical illustration of the horizontal coil turns distribution for a prior art deflection yoke for generating uniform-field magnetic direction. The turns distribution contains nearly no Fourier harmonic content above H1st.

Figure 25:
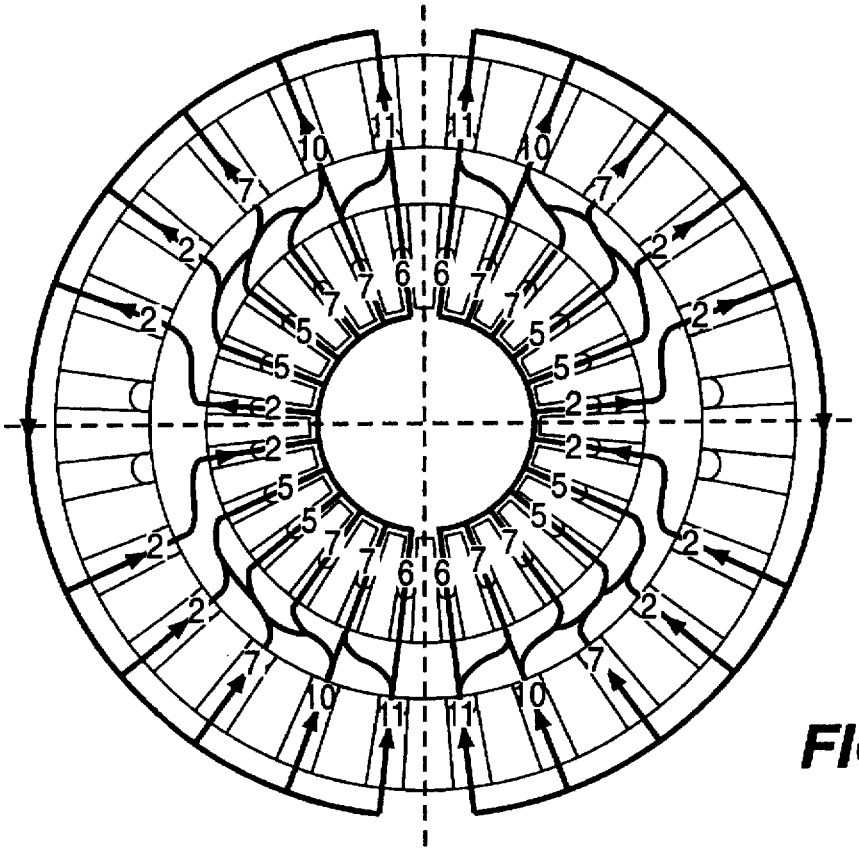
FIG. 25 is a front plan view of a yoke which illustrates the vertical coil turns distribution in an exemplary embodiment of the invention.

FIG. 25 is a graphical illustration of the vertical coil turns distribution in an exemplary embodiment of the invention for a deflection yoke generating non-uniform-field magnetic deflection. Exit 3rd harmonic is added to the winding distribution to reduce side pincushion distortion of the CRT raster. Entrance 3rd harmonic is added in an opposing sense to the winding distribution to reduce astigmatism of deflected beam spots.

Figure 26:
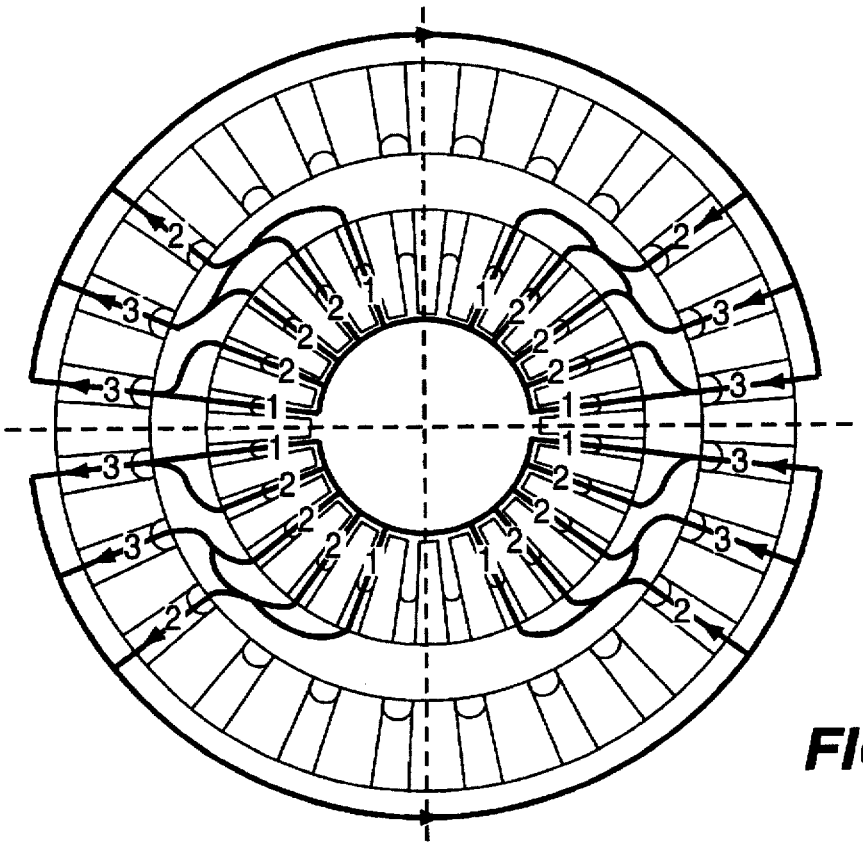
FIG. 26 is a front plan view of a yoke which illustrates the horizontal coil turns distribution in an exemplary embodiment of the invention.

FIG. 26 is a graphical illustration of the horizontal coil turns distribution in an exemplary embodiment of the invention for a deflection yoke generating non-uniform-field magnetic deflection for reducing corner spot shape distortion. Exit 3rd harmonic is added to the winding distribution to reduce raster pincushion distortion along top/bottom and sides of the CRT raster. Entrance 3rd harmonic is added in an opposing sense to the winding distribution to reduce astigmatism of deflected beam spots.

The invention includes harmonic windings on the yoke to replace conventional quadrupole coils. In a first embodiment, two of the conventional quadrupole coils are eliminated by harmonic windings on the yoke resulting in less complex driving circuitry and less power consumption. In a second embodiment, harmonic windings on the yoke entrance region allow the stigmator to be driven with low frequency signals and vertical quadrupole coils in the yoke exit region provide for fine tuning of the image resolution. This allows the stigmator to be placed adjacent to the electron gun which reduces the overall length of the CRT and increases the resolution of the CRT. In a third embodiment of the invention, harmonic windings in the yoke exit overfocus the electron beam in a direction parallel to the direction of the spot elongation along the diagonals. Vertical quadrupole coils in the entrance region allow fine tuning of the image resolution.

While the invention has been described with reference to exemplary embodiments, it is not limited thereto. Rather, the appended claims should be construed to include other variants and embodiments of the invention which may be made by those skilled in the art without departing from the true spirit and scope of the invention.

What is claimed:

1. A deflection yoke for correcting spot shape distortion of an electron beam generated spot along the diagonals of a monochrome cathode ray tube screen comprising:

yoke entrance region including horizontal and vertical harmonic windings on the yoke configured to produce a barrel-shaped deflection field at said yoke entrance region which overfocuses the electron beam in a direction perpendicular to the direction of the distortion along the diagonals of the screen; and yoke exit region including horizontal and vertical harmonic windings on the yoke configured to produce a pincushion-shaped deflection field at said yoke exit region which overfocuses the electron beam in a direction parallel to the direction of the distortion along the diagonals of the screen;

wherein the combination of the entrance region windings and the exit region windings generate a non-uniform field to correct the spot shape distortion of the electron beam generated spot along the diagonals of the cathode ray tube screen.

2. The yoke of claim 1, wherein said harmonic windings in said yoke entrance region produce a deflection field having a negative third harmonic component.

3. The yoke of claim 1, wherein said harmonic windings in said yoke exit region produce a deflection field having a positive third harmonic component.

4. A deflection apparatus for correcting spot shape distortion of an electron beam generated spot on a monochrome cathode ray tube, the electron beam having a horizontal scan rate and a vertical scan rate, the apparatus comprising:

a stigmator including horizontal quadrupole coils for correcting spot astigmatism of the electron beam along the axes of the cathode ray robe, said stigmator being responsive to signals at the vertical scan rate to a greater degree than signals at the horizontal scan rate; and a yoke having a yoke entrance region including horizontal and vertical harmonic windings for producing a barrel-shaped deflection field at said yoke entrance region which overfocuses the electron beam in a direction perpendicular to the direction of the spot shape distortion along the diagonals of the screen;

wherein the combination of the quadrupole coils and the yoke entrance region windings generates a non-uniform field to correct the spot shape distortion on the cathode ray tube screen.

5. The apparatus of claim 4, wherein said harmonic windings in said yoke entrance region produce a deflection field having a negative third harmonic component.

6. The apparatus of claim 4, further comprising:

first quadrupole coils for correcting spot elongation of the electron beam along the axes of the cathode ray tube.

7. The apparatus of claim 6, further comprising:

second quadrupole coils for correcting spot elongation of the electron beam along the diagonals of the cathode ray tube.

8. The apparatus of claim 4, further comprising:

a plurality of metal grids for creating a field for focusing the electron beam; and wherein said stigmator is located adjacent to said plurality of metal grids.

9. The apparatus of claim 7, wherein the second quadrupole coil adjusts a resolution of an image on said cathode ray tube screen.

10. A deflection apparatus for correcting spot shape distortion of an electron beam generated spot on a monochrome cathode ray tube, the electron beam having a horizontal scan rate and a vertical scan rate, the apparatus comprising:

a stigmator including horizontal quadrupole coils for correcting spot astigmatism of the electron beam along the axes of the cathode ray tube, said stigmator being responsive to signals at the vertical scan rate to a greater degree than signals at the horizontal scan rate; and a yoke having a yoke exit region including horizontal and vertical harmonic windings for producing a pincushion-shaped deflection field at said yoke exit region which overfocuses the electron beam in a direction parallel to the direction of the spot shape distortion along the diagonals of the screen;

wherein the combination of the quadrupole coils and the yoke exit region windings generates a non-uniform field to correct the spot shape distortion on the cathode ray tube screen.

11. The apparatus of claim 10, wherein said harmonic windings in said yoke exit region produce a deflection field having a positive third harmonic component.

12. The apparatus of claim 10, further comprising:

first quadrupole coils for correcting spot elongation of the electron beam along the axes of the cathode ray tube.

13. The apparatus of claim 12, further comprising:

second quadrupole coils for correcting spot astigmatism of the electron beam along the diagonals of the cathode ray tube.

14. The apparatus of claim 10, further comprising:

a plurality of metal grids for creating a field for focusing the electron beam; and wherein said stigmator is located adjacent to said plurality of metal grids.

15. The apparatus of claim 13, wherein said second quadrupole coils adjust a resolution of an image on said cathode ray tube screen.

16. A deflection yoke according to claim 1, wherein both the yoke entrance region windings and the yoke exit region windings have a common core.

17. A deflection yoke according to claim 1, the deflection yoke further comprising quadrupole coils in the yoke entrance region for correcting spot elongation along the axes of the cathode ray tube screen.

18. A deflection yoke according to claim 1, wherein:

the horizontal entrance region and exit region windings are a single winding; and the vertical entrance region and exit region windings are a single winding.

* * * * *